US006701572B2

(12) United States Patent
Bechthold

(10) Patent No.: US 6,701,572 B2
(45) Date of Patent: Mar. 9, 2004

(54) FLAP HINGE

(75) Inventor: Ralpf Bechthold, Remscheid (DE)

(73) Assignee: Edscha AG, Remscheid (DE)

( * ) Notice: Subject to any disclaimer, the term of this patent is extended or adjusted under 35 U.S.C. 154(b) by 0 days.

(21) Appl. No.: 10/221,803

(22) PCT Filed: Mar. 21, 2001

(86) PCT No.: PCT/DE01/01097

§ 371 (c)(1),
(2), (4) Date: Sep. 16, 2002

(87) PCT Pub. No.: WO01/71136

PCT Pub. Date: Sep. 27, 2001

(65) Prior Publication Data

US 2003/0115718 A1 Jun. 26, 2003

(30) Foreign Application Priority Data

Mar. 21, 2000 (DE) ..... 100 13 726

(51) Int. Cl.[7] ..... E05D 7/04

(52) U.S. Cl. ..... 16/235; 16/249; 16/241; 16/239; 16/386

(58) Field of Search ..... 16/249, 235, 241, 16/239, 338, 339, 340, 375, 374, 371, 386; 403/147, 156, 157, 154, 150; 180/69.21, 69.2, 69.24, 274; 49/386, 381, 382, 399, 390, 389; 296/76, 146.11

(56) References Cited

U.S. PATENT DOCUMENTS

| | | | | | |
|---|---|---|---|---|---|
| 1,042,936 | A | * | 10/1912 | Loughren | 16/340 |
| 1,818,182 | A | * | 8/1931 | Woernle | 16/340 |
| 1,967,104 | A | * | 7/1934 | Sorrow, Jr. | 4/236 |
| 3,880,444 | A | * | 4/1975 | Bridges | 280/86.753 |
| 4,485,524 | A | * | 12/1984 | Neville | 16/241 |
| 4,620,344 | A | * | 11/1986 | Lewis, Jr. | 16/337 |
| 4,727,621 | A | * | 3/1988 | Emery et al. | 16/239 |
| 4,958,877 | A | * | 9/1990 | Lezotte et al. | 16/250 |
| 5,557,829 | A | * | 9/1996 | Schoen et al. | 16/375 |
| 5,772,351 | A | * | 6/1998 | Ching | 403/111 |
| 5,937,482 | A | * | 8/1999 | Horng | 16/340 |
| 6,286,185 | B1 | * | 9/2001 | Ramsauer | 16/236 |
| 6,453,509 | B1 | * | 9/2002 | Shin | 16/340 |

FOREIGN PATENT DOCUMENTS

| | | | |
|---|---|---|---|
| DE | 443051 | | 4/1927 |
| DE | 3535487 | A1 * | 4/1987 |
| DE | 4032930 | | 4/1992 |
| DE | 4218253 | | 12/1992 |
| EP | 0323065 | A1 * | 12/1988 |
| FR | 2145891 | | 2/1973 |
| GB | 1106408 | | 3/1968 |
| GB | 2217776 | | 11/1989 |
| JP | 10-152075 | * | 6/1998 |
| JP | 11-22278 | * | 1/1999 |

* cited by examiner

*Primary Examiner*—Chuck Y. Mah
(74) *Attorney, Agent, or Firm*—Davidson, Davidson & Kappel, LLC

(57) ABSTRACT

A flap hinge for connecting a flap, for example, a front lid or a boot lid, to a body of a motor vehicle in an articulated manner. The hinge includes a first stop component for fixing to the flap, a second stop component for fixing to the body and a connecting member. Openings of the two stop components are interspersed by said member. At least one of the two stop components can be pivoted around said member, which is provided with thread sections on both ends thereof. An opening of one of the two stop components respectively is interspersed by said sections. Each one of the two stop components can be adjusted separately by means of detachable nuts. A flap hinge is provided, which enables a pivoting moment to be adjusted in a defined manner without affecting the adjustment of the position. At least one of the openings is configured as an elongated hole.

10 Claims, 4 Drawing Sheets

FLAP HINGE

BACKGROUND OF THE INVENTION

The invention relates to a flap hinge for the articulated connection of a flap, e.g. a front hood or a trunk lid, to a motor-vehicle body, comprising a first attachment part for fastening to the flap, a second attachment part for fastening to the vehicle body, and a connecting element, which passes through through-passages of the two attachment parts and around which at least one of the two attachment parts can be pivoted, wherein the connecting element is provided, at both ends, threaded sections, which each pass through a through-passage of one of the two attachment parts, and wherein each of the two attachment parts can be adjusted separately by means of releasable nuts.

Flap hinges for front hoods which comprise two attachment parts of which the single articulated connection is produced by a threaded bolt, the two attachment parts comprising an intermediate disk, which is positioned on the threaded bolt as well, and possibly maintenance-free bushings, that end of the bolt which is directed away from the head being accommodated in an internally threaded clamping part, are known from practice. In the case of the known flap hinge, it is also provided that one attachment part has a slot so that, once the bolt has been loosened, it can be adjusted in height in order for it to be possible to compensate for inaccuracies upon adjustment of the two hinges of a front lid or of the position of the front hood in the lock, in order for it to be possible to optimize the position of the front hood relative to the vehicle body as a whole. At the same time, the forces of the hinge are adjusted via the threaded bolt, that is to say the hinge can be adjusted to a smoother setting by virtue of the threaded bolt being loosened and to a stiffer setting by virtue of the threaded bolt being tightened. The disadvantage with the known flap hinge is the fact that, when the threaded bolt is loosened for adjusting the pivoting moment of the flap hinge, there is a risk, at the same time, of the already adjusted height setting being lost since, in the case of the threaded bolt being loosened too much, the slot falls under the load of the front hood. It is likewise the case, during the height adjustment, that there is always a risk of the bearing being damaged.

DE-A-40 32 930 shows a hinge joint, having a hinge pin as connecting element, from which a collar projects radially and of which the two ends are designed with threaded extensions onto which nuts can be screwed. An abutment plate for fastening to the vehicle body has the threaded extension passing through it. A hinge eyelet of an attachment part has the other threaded section passing through it. There is no provision for at least one of the through-passages in the attachment parts to be designed as a slot. The disadvantage with the hinge joint is, in particular, the fact that it is not possible, when a door is fitted in, to compensate for the tolerances without, at the same time, adjusting the pivoting moment of the hinge joint.

DE-C-443 051 describes the articulation of a door by means of two hinges, in the case of which a first hinge half is connected to a door element and a second hinge half is connected in a stationary manner to a door post, a hinge pin passing through in each case two angled wings of each of the two hinge halves. A bearing collar keeps at least one pair of the two hinge wings at a distance apart from one another. The hinge pin, at both ends, is provided with threaded sections which make it possible to apply nuts for securing the hinge pin. The through-passages in the wings of the door-post hinge half are designed as slots, in order for it to be possible for the door to be adjusted horizontally in the closed position of the hinge. The vertical adaptation takes place by using another bearing collar. The disadvantage of this articulation is, in particular, the fact that, when the nuts provided at one end or the other are loosened, the hinge pin can also move axially, with the result that this can also affect the sliding pairing with the second hinge half.

SUMMARY OF THE INVENTION

It is an object of the present invention to provide a flap hinge, which allows a defined pivoting-moment adjustment without adversely affecting the position setting.

The present invention provides a flap hinge for an articulated connection of a flap to a motor vehicle body. The flap hinge includes a first attachment part for fastening to the flap, including a first through-passage and a second attachment part for fastening to the vehicle body, including a second through-passage. At least one of the first and second through-passages includes a slot. The flap hinge also includes a connecting element passing through the first and second through-passages. The connecting element includes a first threaded section at a first end thereof and a second threaded section at a second end thereof. The first and second threaded sections are each configured to pass through a respective one of the first and second through-passages. At least one of the first attachment part and of the second attachment part can be pivoted around the connecting element. The flap hinge also includes a first releasable nut disposed on the first threaded section and a second releasable nut disposed on the second threaded section. Each of the first and second releasable nuts is arranged on a side of a respective attachment part facing away from the other attachment part. The first attachment part and the second attachment part are each capable of being adjusted separately using one of the first and second releasable nuts.

The flap hinge according to the invention makes it possible, by virtue of the nut assigned to the first detached part being loosened, to adjust the height setting by displacing the slot relative to the threaded section without thus changing the setting of the torque at the second attachment part. By virtue of the nut assigned to the second attachment part being loosened, in contrast, it is possible for this torque to be adjusted without the height setting of the first attachment part being lost. It has to be understood that the thread of the threaded section can be limited, if appropriate, to the connecting-element ends intended for engagement with the nut, while the rest of the circumference of the threaded section is, for example, of smooth design or is set back from the circumference.

The connecting element is preferably designed with a circumferentially at least partially projecting disk, which is arranged in its central region and on both sides of which the threaded sections extend, with the result that in each case one of the first and second attachment parts can be arranged on both sides of the disk section and the disk prevents the attachment parts from rubbing against one another. Expediently provided for this purpose is a fully formed disk which is optionally designed in one piece with the connecting element, e.g. by being produced from a rotary part, into which the thread turns have then been chased, or by a single part having been formed by extrusion. It is alternatively possible for the disk just to be arranged between the threaded sections once the latter has been cut, to be retained in a form-fitting and force-fitting manner, for example, on a circumferential knurling, to be shrunk on or, if appropriate, if the disk is provided with an inner toothing formation, to be screwed into the desired position in the manner of a thread spindle and fixed in a stationary manner.

The disk preferably comprises, at least on one side, a stub section which is adapted to the through-passage of the attachment part abutting there and at least partially passes through the through-passage of the corresponding attachment part, the stub section being at least partially adapted to the contour of said attachment part. It is thus advantageously possible for the stub section assigned to the slot to have an outer contour, for example an oval contour, which prevents rotation in the slot but of which the length is considerably shorter than the length of the slot, with the result that displacement back and forth in the slot is possible. A further stub section, which is assigned to the second attachment part, on that side of the disk section which is directed away from the slot, in contrast, may have the cylindrical outer contour, in order to define a smooth-running joint as a mount for the likewise circular through-passage. The torque is then prominently adjusted by the nut being prestressed axially, in the direction of the threaded section, against the corresponding attachment part.

According to an alternative configuration, it is possible to provide slots in both attachment parts, said slots extending at an angle to one another, preferably such that height adjustment is possible in one slot and adjustment in the direction of travel of the vehicle is possible in the other slot. The pivoting moment of the flap hinge is then preferably set at the last-mentioned slot.

The flap hinge according to the invention may be designed as a single-joint hinge, in which case the connecting element coincides with the single pivot axis of the two attachment parts; it is alternatively possible for the flap hinge to be designed as a multiple-joint hinge, in which case the connecting element coincides with the articulation of a link of the multiple joint to one of the attachment parts, the first or the second attachment parts then analogously constituting a link which is articulated on the attachment part for fastening on the corresponding other arrangement part.

Further advantages and features of the invention will become apparent from the following description and from the claims.

DESCRIPTION OF THE DRAWINGS

The invention is explained in more detail hereinbelow by way of a preferred exemplary embodiment and with reference to the attached drawings.

DETAILED DESCRIPTION

Figure 1:
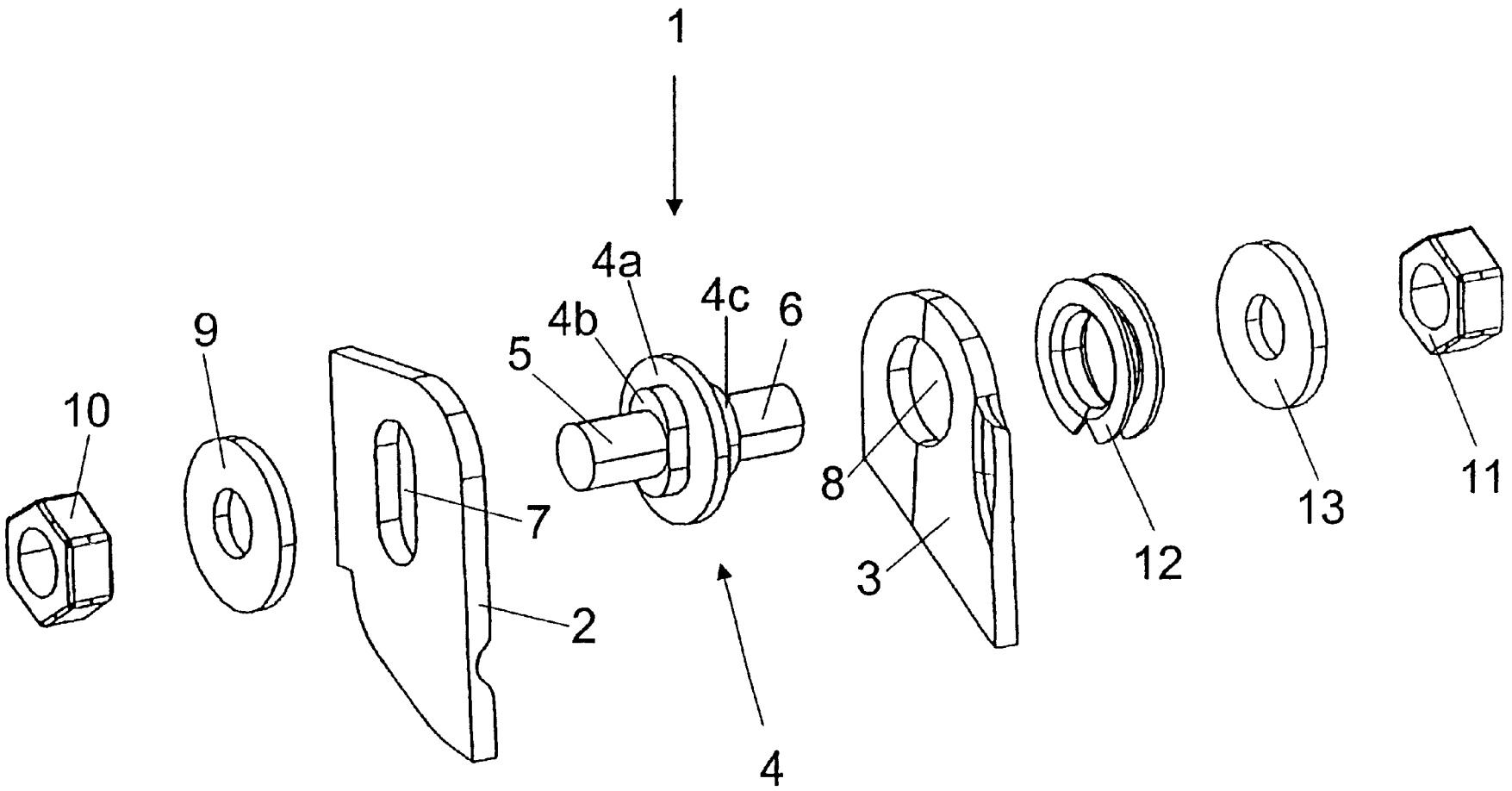
FIG. 1 shows an exploded illustration of a preferred exemplary embodiment of a flap hinge according to the invention, in the case of which only sections of the attachment parts are illustrated.

The flap hinge, which is designated 1 overall in FIG. 1, comprises a first, flap attachment part 2 and a second, vehicle-body attachment part 3, which are connected to one another to form a pivoting joint via a connecting element, which is designated 4 overall and is produced as an extruded part.

The connecting element 4 comprises a threaded section 5, which is assigned to the flap attachment part 2, and a threaded section 6, which is assigned to the vehicle-body attachment part 3, the two threaded sections usually being provided with a circumferential thread, it being the case for assembly purposes that the threaded section 5 passes through a through-passage in the flap attachment part 2 in the form of a slot 7, while the threaded section 6 passes through a circular bore 8 in the vehicle-body attachment part 3. In the closed installation position of the flap hinge 1, the slot 7 extends in the vertical direction, irrespective of the geometry of the attachment part 2, and allows a height adjustment of the flap, which is adjusted by the flap hinge.

Figure 2:
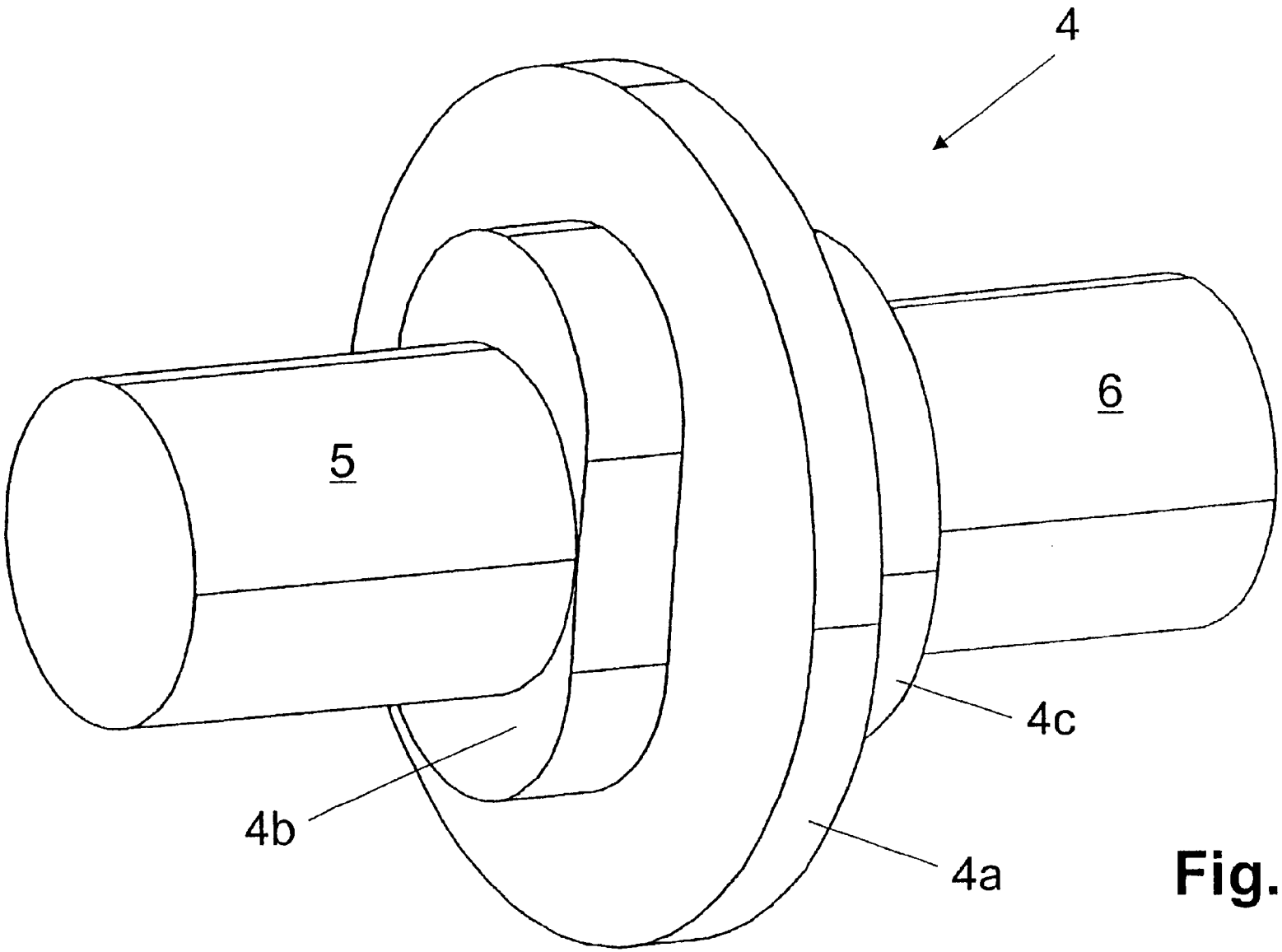
FIG. 2 shows a perspective view, on an enlarged scale, of a connecting element from FIG. 1.
Figure 3:
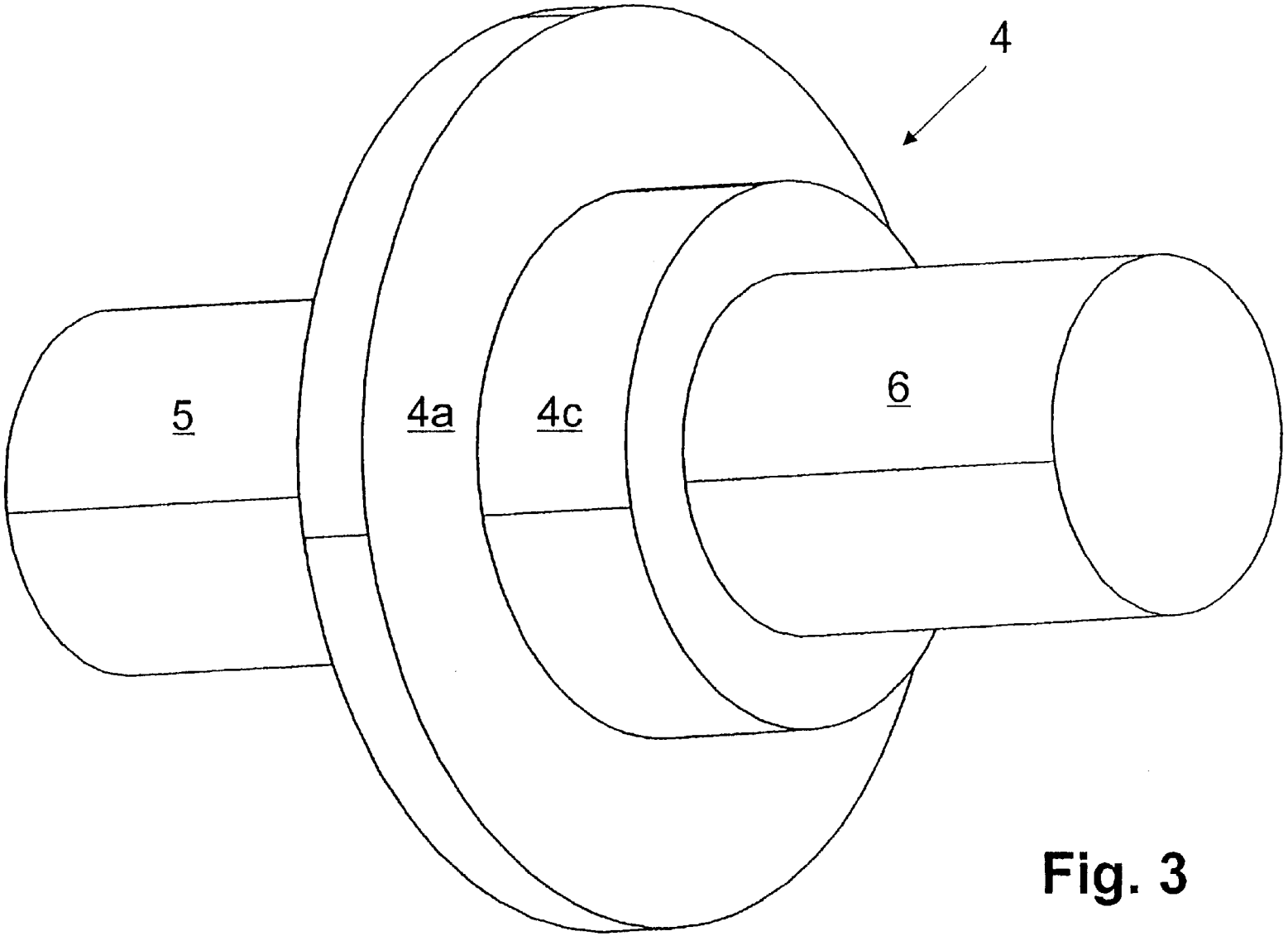
FIG. 3 shows the connecting element from FIG. 2 from another perspective.

As can be seen in FIGS. 2 and 3 in particular, the connecting element 4 comprises a central projecting disk-like extension 4*a*, this disk section 4*a* being arranged in a non-releasable manner on the connecting element 4 between the two threaded sections 5 and 6 and defining an abutment for the two attachment parts 2, 3. This ensures that an abutment exists for each of the two attachment parts, with the result that the pivoting moment or the position, in particular height, of one attachment part can be adjusted independently of that of the respectively other attachment part.

The connecting element 4 comprises, projecting axially from the disk 4*a*, a first, oval stub portion 4*b* and, on the other side a cylindrical stub portion 4*c*, the stub portion 4*b* being designed for engaging with the slot 7 of the flap attachment part 2 and the stub portion 4*c* being designed for engaging in the bore 8 of the vehicle-body attachment part 3. The stub portion 4*b* is oval, the length of the oval being shorter than the length of the slot 7, with the result that axial displacement is possible in the direction of the long axis of the slot, while the width of the stub portion 4*b* is adapted in an essentially play-free manner to the width of the slot 7 such that the parallel edges ensure play-free guidance.

For the purpose of securing the flap attachment part, a washer 9 and a nut 10 are further placed in position on the threaded section 5, it optionally being possible for clamping means in the manner of a spring also to be provided between the washer 9 and nut 10. In the present exemplary embodiment, however, it is not necessary for the flap attachment part, which is provided with slot 7 to be arranged in a pivotable manner, with the result that the surface pressure of the washer 9 can secure the same.

The vehicle-body attachment part 3 is placed in position on the threaded section and screw-connected by a nut 11, a bushing 12 being arranged in abutment with that flat side of the vehicle-body attachment part 3 which is directed away from the disk 4*a*, and another washer 13 being arranged between said bushing and a nut 11, which is screwed onto the threaded section 5.

Figure 4:
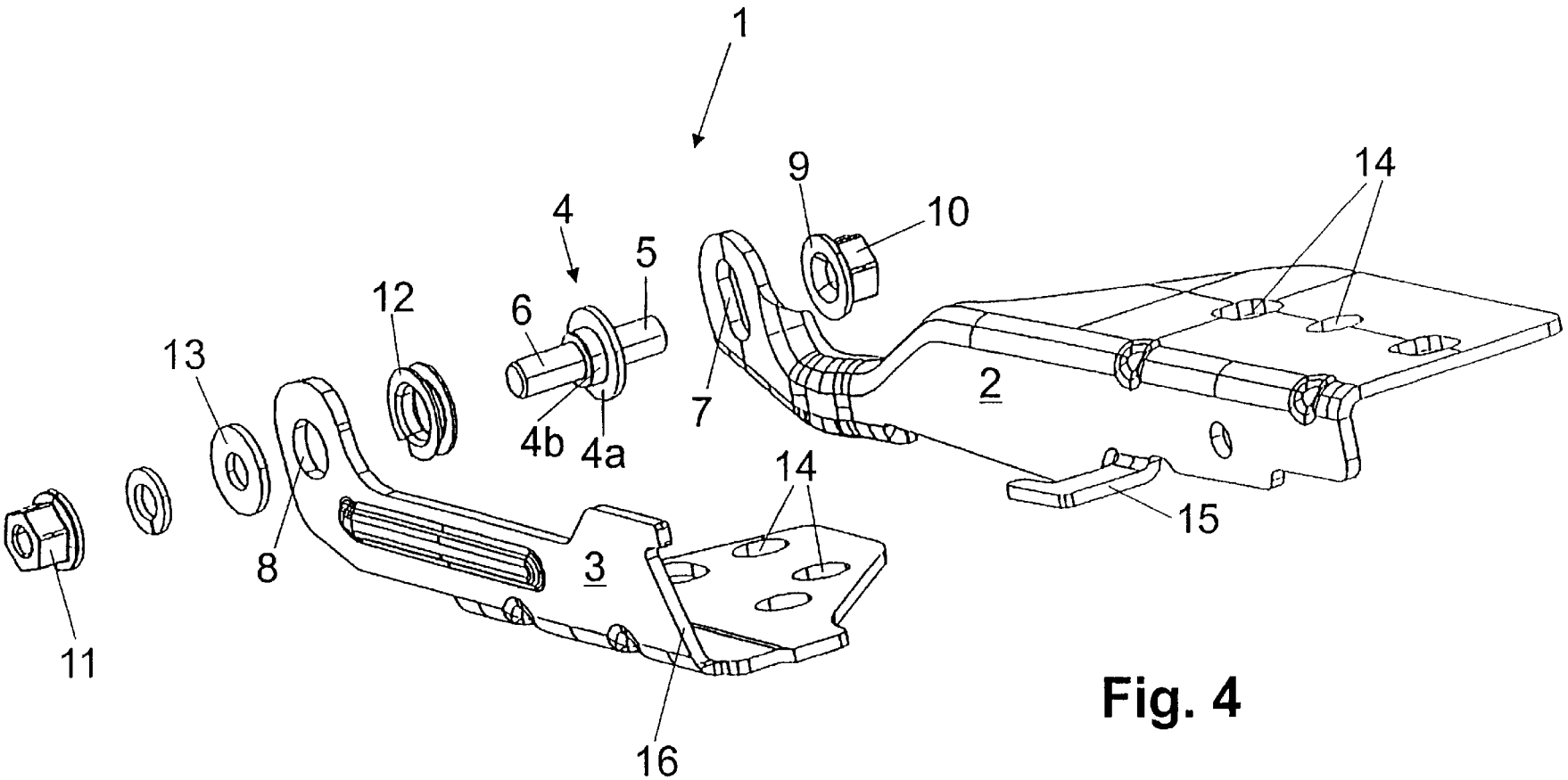
FIG. 4 shows an exploded illustration of the flap hinge from FIGS. 1 to 3 from another perspective.

FIG. 4 illustrates an exploded illustration of a complete flap hinge 1 in perspective, said flap hinge being fitted, for example, on the right-hand side of a front lid, as seen in the direction of travel. The same designations designate the same parts as in FIG. 1. The oval stub portion 4*b* is not visible, on account of the perspective, but is nevertheless present, for passing through the slot 7 of the flap attachment part 2. FIG. 4 shows the bores 14 in the vehicle-body attachment part 3 for fastening on a motor-vehicle body and in the flap attachment part 2 for fastening on a front hood of a motor vehicle, it also being possible to see a hook 15, which projects laterally from the flap attachment part 2, engages over the essentially vertically arranged part 16 of the vehicle-body attachment part, and defines a pivoting-limiting means.

The invention, then, functions as follows:

The flap hinge 1 is assembled in accordance with the exploded illustration from FIG. 1 and is arranged on the flap via the attachment part 2. The pivoting moment of the flap hinge 1 is essentially adjusted by the stressing force of the nut 11, with the result that the flap, for example a front hood, can be introduced, together with the flap hinge 1, into the vehicle body, where the vehicle-body attachment part is screw-connected, or fastened in some other way, outside the joint via further through-passages (not illustrated). In order to align the flap with the fenders or other parts of the vehicle, it is expedient if, once the flap has been positioned, it can be adjusted in height by displacement of the stub 4*b* in the slot 7. For this purpose, in the case of the flap hinge 1, it is no longer necessary to loosen the entire connection, with the result that the pivoting moment of the flap does not change and does not have to be reset. Damage to the bearing is also expediently prevented as a result.

The invention has been illustrated above by way of an exemplary embodiment in the case of which the slot is arranged in the flap attachment part. It has to be understood that it is likewise possible for this through-passage, or some other through-passage which does not have a circular-cylindrical contour, to be provided in the vehicle-body attachment part, and that, as an alternative to securing the flap in the vertical direction, it is also possible for the longitudinal extent of the slot to be formed along an axis other than the vertical.

What is claimed is:

1. A flap hinge for an articulated connection of a flap to a motor vehicle body, the flap hinge comprising:

a first attachment part for fastening to the flap, including a first through-passage, a second attachment part for fastening to the vehicle body, including a second through-passage, wherein at least one of the first and second through-passages includes a slot;

a connecting element passing through the first and second through-passages, the connecting element including a first threaded section at a first end thereof and a second threaded section at a second end thereof, the first and second threaded sections each configured to pass through a respective one of the first and second through-passages, wherein at least one of the first attachment part and of the second attachment part can be pivoted around the connecting element;

a first releasable nut disposed on the first threaded section; and a second releasable nut disposed on the second threaded section, wherein each of the first and second releasable nuts is arranged on a side of a respective attachment part facing away from the other attachment part and wherein the first attachment part and the second attachment part are each capable of being adjusted separately using one of the first and second releasable nuts.

2. The flap hinge as claimed in claim 1, wherein the connecting element includes a circumferentially projecting disk section, the first and second threaded sections extending from respective sides of the disk section.

3. The flap hinge as claimed in claim 2, wherein the disk section and the threaded sections are of one piece.

4. The flap hinge as claimed in claim 2, wherein the disk section includes a first stub section on one side, the stub section adapted to one of the first and second through-passages.

5. The flap hinge as claimed in claim 4, wherein the one of the first and second through-passages includes the slot, the first stub section including a first outer contour preventing rotation of the stub section in the slot.

6. The flap hinge as claimed in claim 5, wherein the first outer contour is oval.

7. The flap hinge as claimed in claim 4, wherein the disk section includes a second stub section directed away from the through-passage defined as a slot, the second stub having a second cylindrical outer contour for accommodating the other of the first and second through-passages.

8. The flap hinge as claimed in claim 2, wherein the disk section is rigidly engaged with respect to the first and second threaded sections of the connecting element, the disk section being retained relative to the threaded sections using knurling between the threaded sections.

9. The flap hinge as claimed in claim 1, wherein the connecting element coincides with a single pivot axis of the two attachment parts.

10. The flap hinge as claimed in claim 1, wherein the connecting element is a single-piece extruded part.

* * * * *